United States Patent [19]

Stromberg

[11] Patent Number: 4,736,222

[45] Date of Patent: Apr. 5, 1988

[54] LIQUID DISTRIBUTION BOX

[75] Inventor: Peter G. Stromberg, Rochester, N.Y.

[73] Assignee: Eastman Kodak Company, Rochester, N.Y.

[21] Appl. No.: 64,421

[22] Filed: Jun. 22, 1987

[51] Int. Cl.[4] ..... G03D 3/02

[52] U.S. Cl. ..... 354/324; 354/321

[58] Field of Search ..... 354/320, 321, 322, 324, 354/325, 328; 134/64 P, 122 P

[56] References Cited

U.S. PATENT DOCUMENTS

| | | | |
|---|---|---|---|
| 3,192,845 | 7/1965 | Schmidt | 354/321 |
| 3,311,039 | 3/1967 | Lucas | 134/122 P |
| 3,595,159 | 7/1971 | Bull | 134/122 P |
| 3,831,612 | 8/1974 | Limoges | 134/122 |
| 3,860,944 | 1/1975 | Huber et al. | 354/324 |
| 3,922,702 | 11/1975 | Gaskell | 354/321 |
| 4,312,585 | 1/1982 | Otsu et al. | 354/321 |
| 4,332,454 | 6/1982 | Hensel et al. | 354/317 |
| 4,512,645 | 4/1985 | Engelhardt et al. | 354/324 |
| 4,613,221 | 9/1986 | Takase et al. | 354/321 |

*Primary Examiner*—A. A. Mathews

*Attorney, Agent, or Firm*—Roger A. Fields

[57] ABSTRACT

In film processing apparatus provided with (a) a tank into which a processing liquid is pumped; (b) a pair of oppositely spaced film process channels in the tank; (c) a plurality of liquid ingress openings to the channels for directing a processing liquid pumped into the tank to flow into the channels against the emulsion side of a filmstrip advanced along the channels; and (d) a plurality of liquid egress openings from the channels for enabling the processing liquid flowing against the emulsion side of the filmstrip to flow around the longitudinal edges of the filmstrip and out of the channels into the tank, an improvement is added comprising a processing liquid distribution box. The distribution box is disposed in the tank between the film process channels to receive a processing liquid pumped into the tank, and it includes respective series of staggered relatively small orifices positioned to discharge the processing liquid in a jet-like manner from the box interior into the liquid ingress openings to the film process channels. The orifices effect an improved agitation of the processing liquid adjacent the emulsion side of a filmstrip in the channels.

8 Claims, 4 Drawing Sheets

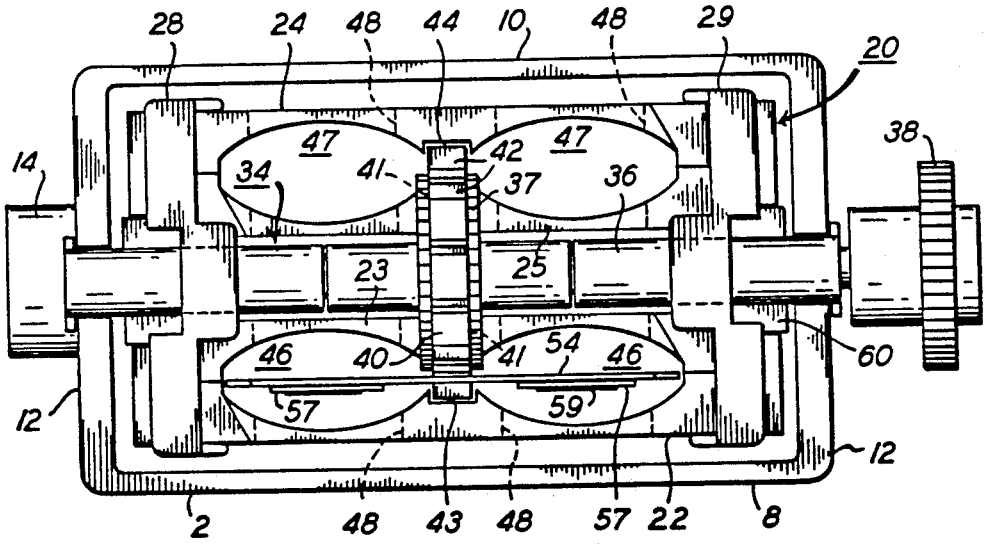
FIG. 2
FIG. 4
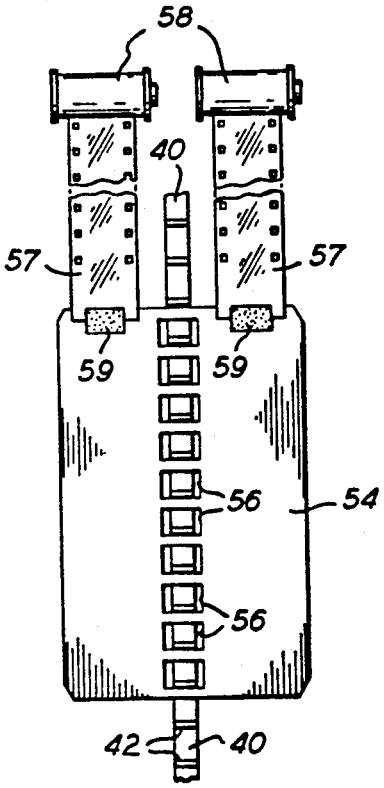
FIG. 5
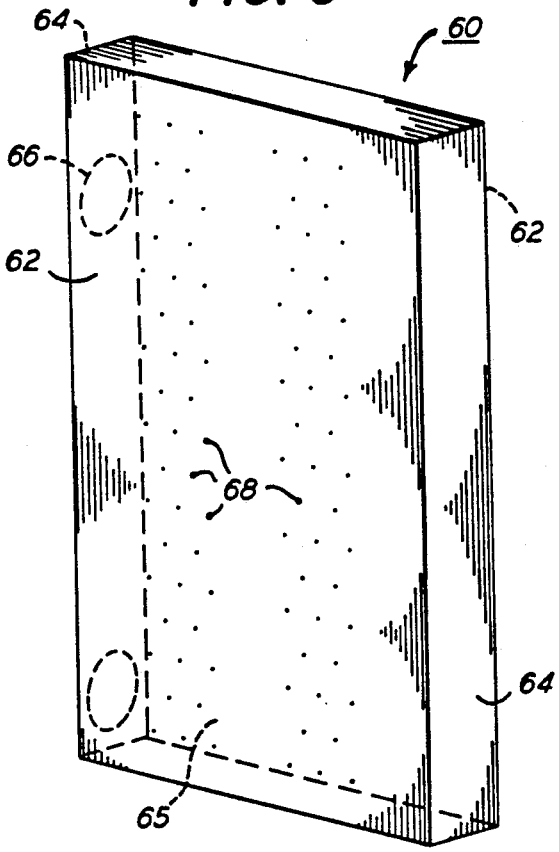

LIQUID DISTRIBUTION BOX

CROSS-REFERENCE TO A RELATED APPLICATION

Reference is made to commonly assigned, copending patent application Ser. No. 064,420 entitled Apparatus for Photographic Film Processing, and filed June 22, 1987 in the names of Robert J. Blackman and Robert A. Burkovich.

BACKGROUND OF THE INVENTION

1. Field of the Invention

This invention relates generally to a photographic film processing apparatus. More particularly, the invention relates to an apparatus for treating exposed film in one or more processing liquids in a manner which assures that positive application of each processing liquid to the emulsion side of the film as the film is transported through the processing liquid.

2. Description of the Prior Art

The processing of photographic film involves a series of steps such as developing, bleaching, fixing, rinsing, and drying. These steps lend themselves to mechanization by conveying long strips of film sequentially through a series of stations or tanks, each one containing a different processing liquid appropriate to the process step at that station.

Typically, the filmstrip being processed is immersed in and drawn through a developing liquid or other processing liquid. The thoroughness and therefore the quality of processing depends on, among other things, a thorough interaction of the film emulsion and the processing liquid. For effective and quality processing, some movement of the processing liquid, i.e., "agitation", is required to assure that fresh liquid is continually brought into contact with the film emulsion.

The Cross-Referenced Application

In the patent application cross-referenced above, there is disclosed a photographic film processor which includes an upstanding processing rack immersed in a processing liquid tank. The rack has oppositely spaced pairs of mating vertical rack panels, each pair defining a vertical belt path and at least one vertical film process channel. An endless timing belt extends over a drive sprocket at the top of the processing rack, over an idler sprocket at the bottom of the rack, and along the vertical belt paths defined by the respective opposite pairs of vertical rack panels. The timing belt has inner teeth for engagement with the sprockets and outer teeth for engagement with a flexible film leader card to which at least one exposed filmstrip is secured. Rotation of the drive sprocket advances the timing belt continuously along the vertical belt paths to pull the exposed filmstrip down a vertical film process channel in one pair of rack panels and up a vertical process channel in an opposite pair of rack panels. A processing liquid is pumped into a central vertical cavity between the opposite pairs of vertical rack panels and is constrained for positive flow through numerous inlet openings in each inner rack panel at either side of the central cavity. The processing liquid is directed against the emulsion side of successive sections of the filmstrip being pulled along the vertical process channels, and out of corresponding outlet openings in each outer rack panel proximate the walls of the processing tank. Then, the used liquid flows downwardly between each outer rack panel and the tank walls to drain through an outlet port at the tank bottom.

SUMMARY OF THE INVENTION

In film processing apparatus provided with (a) a tank into which a processing liquid is pumped; (b) a pair of oppositely spaced film process channels in the tank; (c) a plurality of liquid ingress openings to the channels for directing a processing liquid pumped into the tank to flow into the channels against the emulsion side of a filmstrip advanced along the channels; and (d) a plurality of liquid egress openings from the channels for enabling the processing liquid flowing against the emulsion side of the filmstrip to flow around the longitudinal edges of the filmstrip and out of the channels into the tank, an improvement is added comprising a processing liquid distribution box. The distribution box is disposed in the tank between the film process channels to receive a processing liquid pumped into the tank, and it includes respective series of staggered relatively small orifices positioned to discharge the processing liquid in a jet-like manner from the box interior into the liquid ingress openings to the film process channels. The orifices effect an improved agitation of the processing liquid adjacent the emulsion side of a filmstrip in the channels.

BRIEF DESCRIPTION OF THE DRAWINGS

FIG. 2 is a top view of the apparatus shown in FIG. 1;

FIG. 4 is a front view of a film leader card showing its attachment to a pair of filmstrips and its engagement with a timing belt;

FIG. 5 is a perspective view of a liquid distribution box used in connection with the apparatus of FIGS. 1–3 in accordance with a preferred embodiment of the invention.

DESCRIPTION OF THE PREFERRED EMBODIMENT

Figure 1:
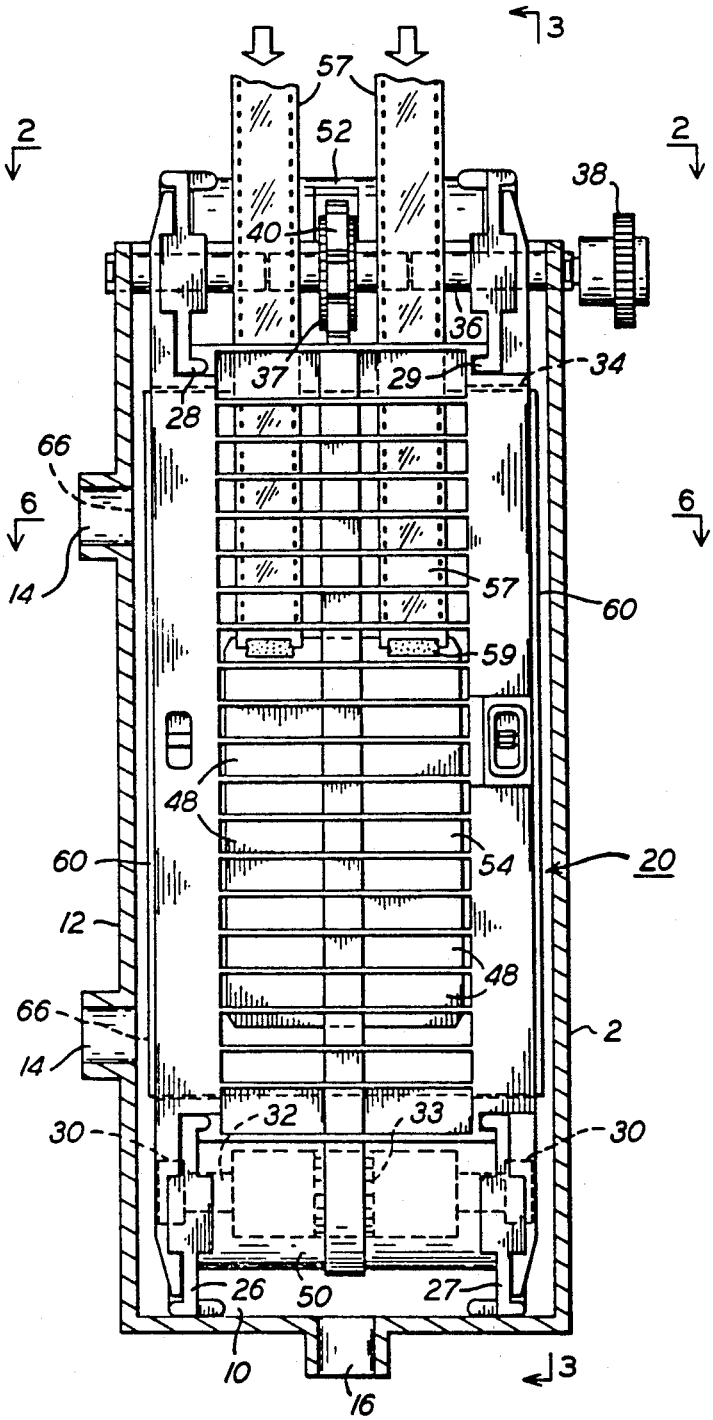
FIG. 1 is a partially sectional front elevation view of a film processing tank and a film processing rack.
Figure 3:
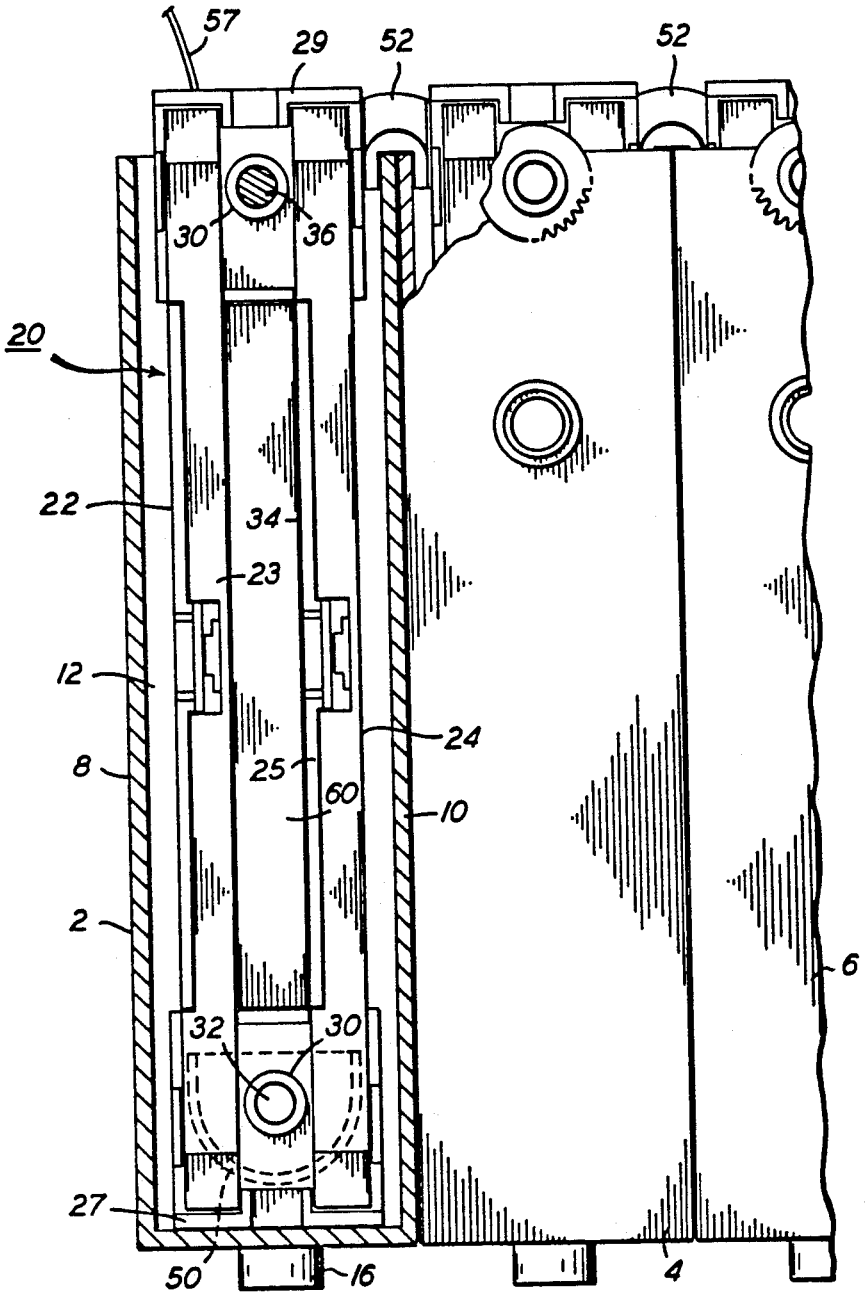
FIG. 3 is a partially sectional side elevation view of a series of film processing tanks, each including the film processing rack of FIG. 1.

Referring to FIGS. 1–3, a film processor is shown which has a plurality of film processing tanks, including a first vertical tank 2 for developing an exposed filmstrip, a second similar tank 4 for the next process step involving the filmstrip, a third similar tank 6 for another process step involving the filmstrip, and so on. Because of the similarity in structure from tank to tank, the details of only the first tank 2 are provided. The first tank 2 has a front (or leading) wall 8, a rear (or trailing) wall 10, and two side walls 12. A pair of upper and lower liquid inlet ports 14 extend through respective upper and lower portions of one of the side walls 12 of the first tank 2, and a single liquid outlet port 16 extends through the bottom of the tank.

An upstanding processing rack 20 is removably set in the first processing tank 2. The vertical rack 20 is an integrated unit having a front (or leading) pair of mating rack panels 22 and 23, and an identical rear (or trailing) pair of mating rack panels 24 and 25. See FIGS. 2 and 3. Each pair of mating rack panels 22, 23 and 24, 25 is vertically supported in the first tank 2 and is held together by a first pair of end blocks 26 and 27 at the bottom end of the rack and an identical second pair of end blocks 28 and 29 at the top end of the rack. In FIGS. 1 and 2, there are shown substantial clearances between the walls 8, 10 and 12 of the first tank 2 and the first processing rack 20. This is only for the sake of illustration to help distinguish the tank 2 and the rack 20. In reality, there is only a small clearance between the rack and the walls of the tank.

Each of the end blocks 26–29 includes a central shaft bearing or journal bearing 30, as shown in FIG. 3. The journal bearings 30 in the bottom pair of end blocks 26, 27 are in axial alignment and together the two end blocks rotatably support an idler shaft 32 between them. An idler sprocket 33 is centrally fixed to the idler shaft 32, as by a known keying arrangement, not shown. The journal bearings 30 in the top pair of end blocks 28, 29 are in axial alignment and together the two end blocks rotatably support a drive shaft 36. The drive shaft 36, as shown in FIG. 1, extends outward of the top end block 29. A drive sprocket 37 is centrally fixed to the drive shaft 36, and a power input sprocket 38 is fixed to the outward extension of the shaft 36.

For the sake of clarity, the pair of mating rack panels 22, 23 closest to the front wall 8 of the first processing tank 2 will be referred to as the front pair, and the pair of mating rack panels 24, 25 closest to the rear wall 10 of the first tank will be referred to as the rear pair. Also, the rack panels 22 and 24 will be referred to as outer panels and the rack panels 23 and 24 will be referred to as inner panels. Between the front and rear pairs of mating rack panels 22, 23 and 24, 25 and between the lower and upper shafts 32 and 36 is a central vertical cavity 34. See FIGS. 2 and 3. An endless timing belt 40 having inner teeth 41 and outer teeth 42 extends over the drive sprocket 37 and under the idler sprocket 33, and by its inner teeth engages the two sprockets for positive synchronous movement as the drive sprocket is rotated. See FIG. 1. The power input sprocket 38 is connected to a drive chain or belt, not shown, which imparts motive power to the drive sprocket 37.

Figure 6:
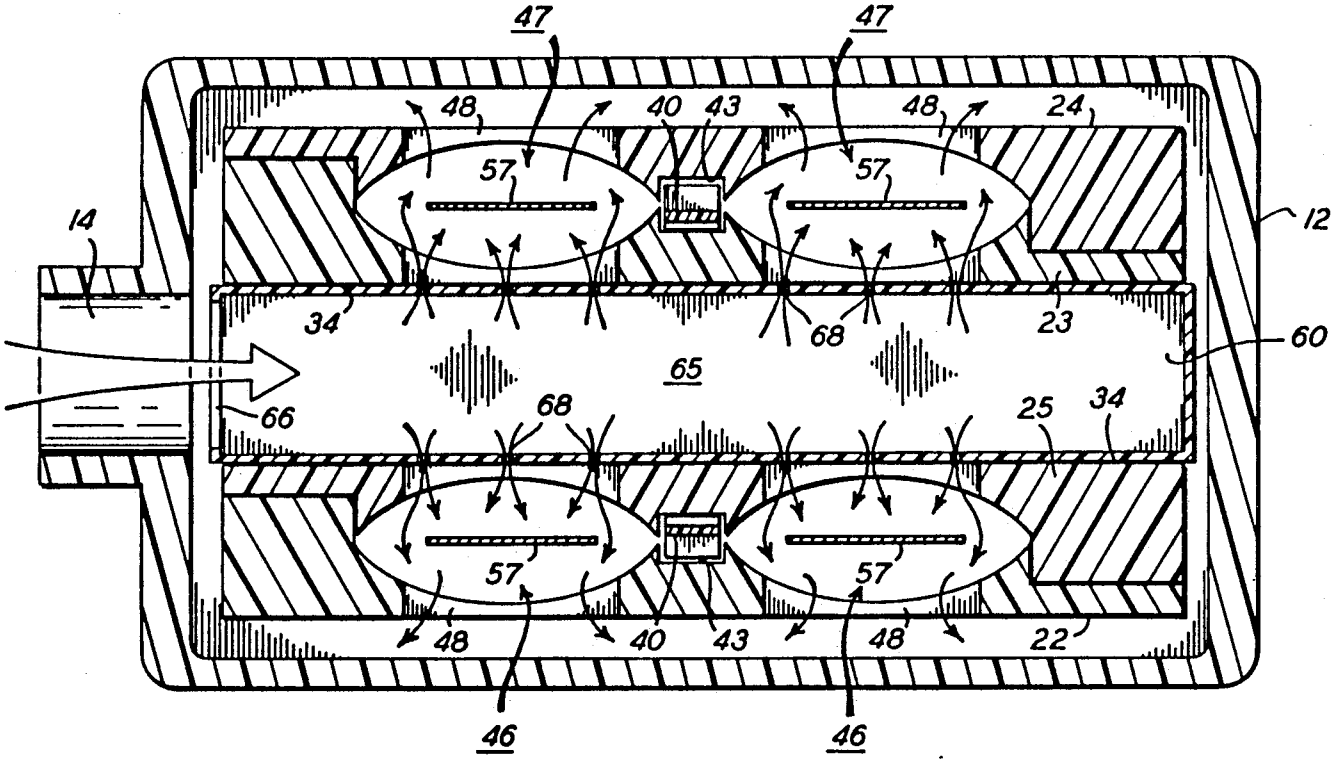
FIG. 6 is a somewhat schematic, transverse sectional view of the film processing rack as seen in the direction of the arrows 6—6 in FIG. 1 and showing the flow path of a processing liquid through the rack.

As best seen in FIGS. 2 and 6, the front pair of mating rack panels 22, 23 define a front central belt clearance slot 43 which extends vertically between these two inner and outer rack panels. Likewise, the rear pair of mating rack panels 24, 25 define a rear central belt clearance slot 44 which extends vertically between these two inner and outer rack panels. The front and rear belt clearance slots 43 and 44 are disposed in parallel, opposite relation. Respective vertical sections of the timing belt 40 between the idler and drive sprockets 33 and 37 extend along the belt clearance slots 43 and 44, and the inner and outer teeth 41 and 42 of the timing belt extend into the belt clearance spaces provided by these two slots.

Also as can be seen in FIGS. 2 and 6, the front pair of mating rack panels 22, 23 define between these two inner and outer rack panels a pair of front vertical process channels 46, one on each side of the front central belt clearance slot 43. Likewise, the rear pair of mating rack panels 24, 25 define between these two inner and outer rack panels a pair of rear vertical process channels 47, one on each side of the rear central belt clearance slot 44. The two pairs of front and rear vertical process channels 46 and 47 are disposed in parallel, opposite relation to permit respective filmstrips to be advanced from the front channels to the rear channels. Each of the rack panels 22, 23, 24, and 25 includes two series of wall openings 48 arranged in respective parallel vertical columns by which the panel walls are open to either the pair of front process channels 46 or the pair of rear process channels 47, as the case may be.

A concave bottom guide member 50, as shown in FIGS. 1 and 3, is mounted between the bottom pair of end blocks 26 and 27. The bottom guide member 50 partially surrounds the idler shaft 32 and the idler sprocket 33, and is configured along its concave interior to form a continuation of the front and rear central belt clearance slots 43 and 44 and the pairs of front and rear vertical process channels 46 and 47. Thus, there is provided a 180 degree or U-turn of the front and rear belt clearance slots 43 and 44 and the pairs of front and rear process channels 46 and 47 to join the front and rear pairs of mating rack panels 22, 23 and 24, 25 in respective belt and film process paths.

A concave top cross-over member 52, as shown in FIG. 3, is mounted between the top pair of end blocks 28 and 29. The cross-over member 52 joins the rear pair of mating rack panels 24, 25 in the first processing tank 2 with a front pair of mating rack panels, not shown, in the second processing tank 4. In order to transfer an exposed filmstrip from the first processing tank 2 to the second processing tank 4, the cross-over member 52 is configured along its concave interior to provide a continuation of the rear belt clearance slot 44 and the rear pair of process channels 47, and it leads directly into a like front pair of process channels and a like front belt clearance slot in the front pair of mating rack panels in the second processing tank 4. This provides a continuation of the film path from one processing tank and rack to the next processing tank and rack.

A rectangular leader card 54, as shown in FIG. 4, is a thin flexible synthetic resin (plastic) sheet having a series of square holes 56 spaced along its length. Two parallel exposed filmstrips 57 unwound from respective spools 58 are secured to the leader card by adhesive tape 59 or other suitable bonding means. The square holes 56 of the leader card 54 receive the outer teeth 42 of the endless timing belt 40, thereby engaging the card and the belt. This allows the timing belt to drive the leader card to pull the two filmstrips 57 through the processing rack 20. When the leader card 54 and the timing belt 40 are engaged, a positive engagement between the two is assured by the fact that the outer teeth 42 of the belt extend through the square holes 56 in the leader card and into the front or rear belt clearance slots 43 or 44. The two filmstrips 57 unwound from the respective spools 58 are drawn through the processing rack 20, down through the respective front process channels 46, along the bottom guide member 50, up through the respective rear process channels 47, and along the top cross-over member 52, from which they emerge and enter a second processing rack in the next processing tank 4. The exposed filmstrips 57 are attached to the leader card 54 in an orientation such that their emulsion sides face inwardly of the processing rack 20 toward the central cavity 34.

Simultaneously with the travel of the leader card 54 and the two filmstrips 57 through the processing rack 20, the processing liquid appropriate to that process station is pumped by a conventional pumping device, not shown, into the first processing tank 2 at its upper and lower inlet ports 14 in one of its two sidewalls 12. The general flow of the processing liquid is schematically indicated in FIG. 6, which is a partial sectional view looking down into the processing rack 20 and the first tank 2, and is similar in certain respects to FIG. 2. After the pumped liquid enters the central cavity 34, the liquid flow is fore and aft (in opposite directions) through the series of wall openings 48 in the inner rack panels 23 and 25 respectively, and into the pairs of front and rear process channels 46 and 47. The liquid is thus forced into dynamic flowing contact (in opposite directions) over the emulsion side of the two filmstrips 57. Then, it flows around the longitudinal edges of the two filmstrips 57 and through the wall openings 48 in the outer rack panels 22 and 24. From there, it flows downwardly between the outer rack panels 22 and 24 and the front and rear walls 8 and 10 of the first tank 2 to the outlet port 16 at the bottom of the tank.

As stated above, the processing rack 20 in the first processing tank 2 is the same as the processing rack in the second tank 4, the third tank 6, and so on. The processing rack 20 in the first tank 2, however, is combined according to the invention with an additional feature not used in the subsequent process stations, owing to the fact that a developing step takes place in the first tank 2. A hollow rectangular liquid distribution box 60, as shown in FIG. 5, removably fits within the central cavity 34, snugly between the front pair of mating rack panels 22, 23 and the rear pair of mating rack panels 24, 25. The distribution box 60 has front and rear faces 62 separated by side and end (top and bottom) walls 64, all defining an internal liquid-receiving chamber 65. The distribution box 60 has two liquid inlet ports 66 in one of its side walls 64, which are aligned with the upper and lower inlet ports 14 of the first tank 2 when the distribution box is operatively positioned within the central cavity 34. The front and rear faces 62 of the distribution box 60 are each perforated by a plurality of relatively small liquid discharge orifices 68. The discharge orifices 68 are arranged in two vertical groups in the front face of the distribution box and two vertical groups in the rear face of the distribution box, these groups corresponding respectively with the pairs of front and rear process channels 46 and 47 of the processing rack 20. Only the two vertical groups of the orifices in one of the faces of the distribution box are shown in FIG. 5. The orifices 68 in each vertical group are disposed in horizontal rows, as shown in FIG. 5, these rows being alternately of two and three orifices to form a staggered relation from row to row. Each of the rows of orifices is in registry with one of the wall openings 48 of the inner rack panels 23 or 25. The introduction of the developer liquid into the pairs of front and rear process channels 46 and 47, and thence to the emulsion sides of the respective filmstrips 57, by pumping the liquid into the internal chamber 65 of the distribution box, and from there through the many small orifices 68, effects an even greater dynamic contact with the film emulsion, and an improved agitation of the developing liquid adjacent the film emulsion, with a consequent improvement in the development process.

If the orifices 68 were not arranged in a staggered relation from row to row, that is, if they had the same (i.e., a non-offset) relation from row to row, it is possible that overdevelopment stripes may form along the emulsion side of the filmstrip.

The invention has been described with reference to a preferred embodiment. However, it will be appreciated that variations and modifications can be effected within the ordinary skill in the art without departing from the scope of the invention.

I claim:

1. In film processing apparatus provided with (a) a tank into which a procesing liquid is pumped; (b) a pair of oppositely spaced film process channels in said tank; (c) a plurality of liquid ingress openings to said channels for directing a processing liquid pumped into said tank to flow into the channels against the emulsion side of a filmstrip advanced along the channels; and (d) a plurality of liquid egress openings from said channels for enabling the processing liquid flowing against the emulsion side of the filmstrip to flow around the longitudinal edge of the filmstrip and out of the channels into said tank; the improvement comprising:

a processing liquid distribution box disposed in said tank between said film process channels to receive a processing liquid pumped into said tank;

said distribution box having respective series of staggered relatively small orifices positioned to discharge the processing liquid from the box interior into said liquid ingress openings to said film process channels.

2. The improvement as recited in claim 1, wherein said respective series of orifices are each a series of alternating numbers of orifices.

3. The improvement as recited in claim 2, wherein the alternating numbers of orifices in said respective series of orifices are the same for each series.

4. The improvement as recited in claim 2, wherein the alternating numbers of orifices in said respective series of orifices alternate between odd and even numbers of orifices.

5. The improvement as recited in claim 4, wherein the alternating numbers of orifices in said respective series of orifices alternate between three and two orifices.

6. The improvement as recited in claim 2, wherein the alternating numbers of orifices in said respective series of orifices constitute alternate numbered rows of orifices.

7. The improvement as recited in claim 6, wherein said alternate numbered rows of orifices in said respective series of orifices are disposed in corresponding registration with said liquid ingress openings to said film process channels.

8. In film processing apparatus provided with (a) a tank into which a processing liquid is pumped; (b) a central cavity in said tank for receiving a processing liquid pumped into the tank; (c) a pair of oppositely spaced film process channels, separated by said cavity, in said tank; (d) a plurality of liquid ingress openings to said channels for directing a processing liquid received in said cavity to flow into the channels against the emulsion side of a filmstrip advanced along the channels; and (e) a plurality of liquid egress openings from said channels for enabling the processing liquid flowing against the emulsion side of the filmstrip to flow around the longitudinal edges of the filmstrip and out of the channels into said tank; the improvement comprising:

a processing liquid distribution box disposed in said central cavity to receive a processing liquid intended for said cavity;

said distribution box having respective series of alternating numbers of relatively small orifices positioned to discharge the processing liquid from the box interior into said liquid ingress openings to said film process channels.

* * * * *